US010266321B2

(12) United States Patent
Van Den Broek

(10) Patent No.: US 10,266,321 B2
(45) Date of Patent: Apr. 23, 2019

(54) DEVICE FOR CLOSING BEVERAGE CONTAINERS AND ASSEMBLY OF SUCH A DEVICE AND A BEVERAGE CONTAINER

(71) Applicants: BBBprojects B.V., Baarn (NL); Louis Rinze Henricus Adrianus Willemsen, Las Pinas (PH)

(72) Inventor: Lucas Karel Johannes Van Den Broek, Baarn (NL)

(73) Assignee: BBBPROJECTS B.V., Las Pinas (PH)

( * ) Notice: Subject to any disclaimer, the term of this patent is extended or adjusted under 35 U.S.C. 154(b) by 633 days.

(21) Appl. No.: 14/775,076

(22) PCT Filed: Mar. 11, 2014

(86) PCT No.: PCT/NL2014/050146
§ 371 (c)(1),
(2) Date: Sep. 11, 2015

(87) PCT Pub. No.: WO2014/142658
PCT Pub. Date: Sep. 18, 2014

(65) Prior Publication Data

US 2016/0023825 A1 Jan. 28, 2016

(30) Foreign Application Priority Data

Mar. 11, 2013 (NL) ..... 2010426

(51) Int. Cl.
*B65D 51/28* (2006.01)
*B65D 81/32* (2006.01)
*B65D 41/34* (2006.01)

(52) U.S. Cl.
CPC ..... *B65D 51/2821* (2013.01); *B65D 41/3419* (2013.01); *B65D 81/3211* (2013.01); *B65D 2101/0046* (2013.01)

(58) Field of Classification Search
CPC ..... B65D 51/2814; B65D 51/2821; B65D 51/2828; B65D 51/2835; B65D 81/3211
See application file for complete search history.

(56) References Cited

U.S. PATENT DOCUMENTS 6,152,296 A * 11/2000 Shih ..... B65D 51/2835 206/222
2006/0006192 A1* 1/2006 Smith ..... B65D 51/2835 222/83

(Continued)

FOREIGN PATENT DOCUMENTS

JP 2009220839 A 10/2009
KR 20110041584 A 4/2011

(Continued)

OTHER PUBLICATIONS

International Search Report and Written Opinion of corresponding International Application No. PCT/NL2014/050146; dated Jun. 18, 2014; 11 pages.

*Primary Examiner* — Andrew T Kirsch
*Assistant Examiner* — Don M Anderson
(74) *Attorney, Agent, or Firm* — Shumaker, Loop & Kendrick, LLP

(57) ABSTRACT

Device for closing beverage containers, comprising a basic structure configured for coupling to the beverage container, the basic structure enclosing at least one passage channel for beverage, a closing element coupled releasably to the basic structure for closing the at least one passage channel, at least one axially displaceable holder which is arranged at least partially in the passage channel and which is at least partially filled with an additive to be added to the beverage, wherein an upper side of the holder to be opened facing toward the closing element and an underside of the holder remote from the closing element initially close the holder substantially medium-tightly, and—at least one lower perforation struc- (Continued)

ture; positioned under an underside of the holder remote from the closing element and configured to perforate the underside of the holder during downward displacement of the holder in the passage channel in the direction of the lower perforation structure, whereby the additive can be released to beverage present in the beverage container.

50 Claims, 6 Drawing Sheets

(56) References Cited

U.S. PATENT DOCUMENTS

| | | | |
|---|---|---|---|
| 2008/0314775 A1 | 12/2008 | Owoc | |
| 2010/0200536 A1* | 8/2010 | Van den Broek | B65D 51/2835 215/316 |

FOREIGN PATENT DOCUMENTS

| | | |
|---|---|---|
| WO | WO 98/40289 A1 | 9/1998 |
| WO | 2009/100544 A1 | 8/2009 |
| WO | 2011/046409 A2 | 4/2011 |

* cited by examiner

DEVICE FOR CLOSING BEVERAGE CONTAINERS AND ASSEMBLY OF SUCH A DEVICE AND A BEVERAGE CONTAINER

TECHNICAL FIELD AND BACKGROUND OF THE INVENTION

The invention relates to a device for closing beverage containers, in particular a bottle. The invention also relates to an assembly of a beverage container, in particular a bottle, and a device according to the invention coupled to the beverage container. The invention further relates to a method for operating an assembly according to the invention.

Consumers nowadays have a wide choice of beverages to which one or more additives are added in order to provide the beverage with a supplemental value. These include for instance sports drinks, health drinks, nutraceuticals, cosmeceuticals or functional foods. These are practically always beverages produced and presented in a standard composition. These beverages are practically all based on water to which the additives have already been added during the production process. In order to facilitate consumption these beverages are generally prepacked in bottles, wherein the consumer can consume the beverage directly from the bottle, and the content of which is intended to be drunk within a time period of several minutes or several hours.

It is also known to initially separate the water and the additive to be added to the water in the bottle by initially storing the additive generally in powder form in the cap of the bottle, wherein the additive can be released and added to the water by uncoupling at least a part of the cap from the bottle. The beverage is thus prepared here by the consumer him/herself just prior to consumption of the beverage. The advantage of this separate initial storage of water and additive in the bottle is that it can for instance considerably improve the shelf-life of the beverage to be formed, and ingredients can be consumed which are present in liquid for only a short time. Such a separation of water and additive is moreover advantageous from a logistic and economic viewpoint because the cap can be filled separately with additive and then separately transported. Filling of the bottle with water and assembly of the bottle and the cap can subsequently take place at a geographically favourable location, whereby transport costs can be considerably reduced. An example of such a bottle is described in the American patent application US 2010/0200536, in which the bottle is filled with water and closed with a special device functioning as cap, the device comprising a basic structure for coupling to the bottle and a closing element coupled releasably by means of a screw thread connection to the basic structure. The basic structure encloses a passage channel for beverage, which passage channel is initially closed and filled with an additive in powder form, such as a water-soluble sugary additive. The passage channel is initially closed on an underside (facing toward the bottle) by a perforable foil and optionally with a more rigid closing member. Positioned in the passage channel is an arm which is connected pivotally to the basic structure and which is provided on the side facing toward the foil with a cutting member. A side of the arm facing toward the closing element is configured for co-action with a top forming part of the closing element. During unscrewing of the closing element from the basic structure an upper side of the arm will be co-displaced by the closing element, as a result of which the arm will pivot and the cutting member will perforate the foil, whereby the additive in powder form can drop into the water, the beverage can be prepared and consumed via the passage channel. The drawback of the known bottle is that it has been found that an additive in powder form can offer relatively great resistance, particularly in the case the additive is compressed to a certain extent, and this can make considerably more difficult, and even prevent, the pivoting of the arm and the cutting member so as to enable perforation of the foil.

BRIEF SUMMARY OF THE INVENTION

An object of the invention is to provide an improved device for enriching a beverage received in a bottle with one or more additives. The invention provides for this purpose a device of the type stated in the preamble, comprising: a basic structure configured for coupling to the beverage container, the basic structure enclosing at least one passage channel for beverage, a closing element coupled releasably to the basic structure for closing the at least one passage channel, at least one axially displaceable holder which is arranged at least partially in the passage channel and which is at least partially filled with an additive to be added to the beverage, wherein a preferably openable upper side of the holder facing toward the closing element and an underside of the holder remote from the closing element initially close the holder substantially medium-tightly, and at least one lower perforation structure positioned under an underside of the holder remote from the closing element and configured to perforate (cut or tear open) the underside of the holder during downward displacement of the holder in the passage channel in the direction of the lower perforation structure, whereby the additive can be released to beverage present in the beverage container. Positioning the lower perforation structure under the holder, and so outside the holder, and displacing the holder in the direction of the lower perforation structure for the purpose of perforating the underside of the holder enables relatively simple and reliable perforation of the holder, whereby the additive can be added to the beverage in relatively simple manner under the influence of gravitational force. After the underside and upper side of the holder have been opened, the holder will also function as passage channel for beverage, whereby possible additive residues can still be dispersed in the water guided through the holder.

The lower perforation structure is provided with one or more cutting elements extending in the direction of the underside of the holder. The cutting elements can be pointed, although at least one cutting element preferably takes a linear or non-linear form so as to enable a line-like incision to be realized in the underside of the holder, whereby the additive will be able to leave the holder relatively easily. The holder will generally be initially filled at least partially with an additive substantially in powder form. It is however also possible to envisage applying other types of additive, such as a tablet or a (viscous) fluid additive, in particular syrup. The holder therefore forms an initially closed capsule provided with one or more additives which can be opened on opposite sides (underside and upper side).

A number of advantageous embodiments of the device according to the invention will be described herein below by way of illustration. Use is made in some embodiments of several inventive concepts. It is possible to envisage individual inventive concepts and technical measures being applied without all details of a determined embodiment also being applied therein.

It will be apparent that diverse modifications to the embodiments described below can be envisaged by a skilled person, wherein a skilled person can combine different inventive concepts and/or technical measures of different embodiments without departing from the inventive concept described in the appended claims.

It is possible to envisage the lower perforation structure taking a stationary form, wherein the orientation between the lower perforation structure and the basic structure does not change. The perforation structure can here even form an integral part of the basic structure. The basic structure and the lower perforation structure can optionally be manufactured here from a polymer in a single injection-moulding step. By then allowing the holder to displace in the direction of the stationary lower perforation structure it is also possible to effect a perforation of the underside of the holder, and thereby release of the additive to the beverage. An advantage of this embodiment variant is that it takes a structurally relatively simple form and can therefore be manufactured relatively inexpensively.

It is however generally more advantageous from a practical viewpoint for the perforation structure to be connected to a lower retaining structure, wherein the orientation between the perforation structure and the lower retaining structure can be changed. This makes it possible to displace the retaining structure and/or the lower perforation structure in the passage channel. This displacement makes it possible on the one hand to perforate the underside of the holder more actively and therefore more reliably, as will be elucidated herein below, and on the other to create a space between the lower perforation structure and the retaining structure, this space being advantageous for allowing substantially unobstructed release of additive to the beverage and for the passage of beverage. It is particularly advantageous for a peripheral wall and/or the underside of the holder to be configured to engage on the lower retaining structure such that, during the downward displacement of the holder, the lower retaining structure is also displaced in downward direction. When the lower perforation structure is axially displaceable relative to the basic structure and relative to the holder, downward displacement of the retaining structure can bring about an upward displacement of the lower perforation structure during the displacement of the holder in downward direction, whereby both the holder and the lower perforation structure are displaced actively toward each other, this generally facilitating perforation of the underside of the holder. In order to prevent the lower perforation structure being displaced only in the same direction as the retaining structure, it is advantageous for the device to comprise at least one bounding element for bounding the downward displacement of the perforation structure. This bounding element can for instance be formed by a protrusion which is connected to the basic structure and which supports the lower perforation structure, or by a another perforation structure lying below the lower perforation structure and configured to perforate a foil of the beverage container.

Various alternative embodiment variants of the at least one bounding element can be envisaged. The bounding element has the primary purpose of bounding the maximum displacement of the lower perforation structure, wherein this maximum displacement is preferably smaller than the displacement which the retaining structure undergoes. Displacing the retaining structure over a greater distance relative to the lower perforation structure makes it possible to change the vertical distance—in the usual vertical orientation of the device—between the retaining structure and the lower perforation structure during this (partially) simultaneous displacement, this being particularly favourable in the case a kinematic reversal of the displacement of the lower perforation structure (preferably in upward direction) and the retaining structure (preferably in downward direction) is desired. In order to be able to realize this kinematic reversal it is advantageous for the lower retaining structure and the lower perforation structure to be mutually connected by means of at least one pivot arm, wherein each pivot arm is pivotally connected with a first outer end to the lower retaining structure and pivotally connected with an opposite second outer end to the lower perforation structure. This generally creates a double film hinge between the retaining structure and the lower perforation structure. Particularly in the case the distance between the two outer ends of each pivot arm is greater in a substantially unloaded state than the distance between the lower retaining structure and the lower perforation structure when the lower retaining structure and the lower perforation structure lie substantially in the same plane, the at least one pivot arm will urge the perforation structure in a direction away from the retaining structure. By bounding the downward displacement of the lower perforation structure the at least one pivot arm will urge the perforation structure in upward direction when the tension on the pivot arm resulting from downward displacement of the retaining structure exceeds a critical tension, whereby the underside of the holder is actively perforated. In this upward (perforating) preferred position the lower perforation structure will remain in stable position, whereby sufficient passage space for additive and beverage can be guaranteed between the perforation structure and the retaining structure. It is particularly advantageous here for the at least one pivot arm to take an angular or curved form. It is also advantageous for the at least one pivot arm to take a resilient form. The at least one pivot arm will generally be manufactured from a polymer, although it is also possible to envisage manufacturing the pivot arm from a different type of material, such as a (resilient) metal. The device preferably comprises a plurality of pivot arms in substantially uniform distribution relative to a peripheral side of the lower perforation structure. A controlled and uniform movement of the lower perforation structure relative to the retaining structure can in this way be guaranteed as well as possible. Application of three pivot arms will generally suffice for this purpose. Applying one or more pivot arms also has the advantage that the perforation structure is initially held at a (safe) distance from the foil for perforating, whereby unintentional opening of the foil can be prevented. It is only by pivoting of the pivot arm(s) that the perforation structure will in fact be activated, wherein the foil will be perforated.

The lower retaining structure generally encloses the lower perforation structure. The lower retaining structure will generally take an annular form here. In order to be able to guarantee a controlled, uniform and generally substantially perpendicular (substantially vertical) displacement of the retaining structure it is generally advantageous that the retaining structure is displaced in the passage channel of the basic structure and thus enclosed, preferably in form-fitting manner, by the passage channel of the basic structure, in particular by a channel wall of the basic structure defining the passage channel. This channel wall preferably also connects substantially form-fittingly to the peripheral wall of the holder. The channel wall generally takes a substantially tubular, in particular substantially cylindrical form, since such a form allows axial rotation of components, such as for instance the holder, connecting to the channel wall. This axial rotation is particularly advantageous when, in addition to a lower perforation structure, use is also made of an upper perforation structure by means of which the closing element can be axially rotated and as a result can be axially displaced, which will be further elucidated herein below.

The underside of the holder is preferably formed by a perforable foil. The foil can be manufactured here from one or more polymers, from a metal, or a combination thereof. Suitable polymers are polypropylene (PP) and/or ethylene vinyl alcohol (EVOH). EVOH has the specific property of functioning as oxygen barrier, this having a positive effect on the preservation of the additive held in the holder. The foil can also comprise aluminum which is optionally provided on one or two sides with a plastic layer, for instance a layer comprising PP or PE, in order to facilitate one-sided or two-sided adhesion of the foil to another part of the holder manufactured from (the same) plastic. It is also possible to envisage the foil comprising aluminum oxide (ALOX), optionally laminated with plastic such as polyethylene terephthalate (PET), whereby an exceptionally thin foil can be obtained with a thickness in the order of magnitude of several microns. The foil is generally connected by means of welding and/or gluing to another part of the holder. The peripheral wall of the holder, which in fact forms the housing of the holder, can for instance be manufactured from plastic, metal, or a combination thereof. The peripheral wall is preferably manufactured from a substantially stiff (rigid) material, or the peripheral wall takes an at least substantially form-retaining form. Such a form-retention of the holder facilitates the transmission of forces exerted on the upper side and/or peripheral wall of the holder for displacement of the holder in downward direction for the purpose of perforating the underside of the holder. The housing is preferably manufactured from a laminated plastic of PP and EVOH, wherein an EVOH material layer is preferably enclosed by two PP material layers, whereby a so-called 'shelf life' of at least 12 months can be guaranteed. The holder, or at least the peripheral wall, can be manufactured by means of different techniques, including injection-moulding and thermoforming. It is also possible to envisage the holder being manufactured by deforming a foil, for instance to a cylindrical shape, wherein the foil is then welded and/or glued. An outer side of the peripheral wall can optionally be provided with a decorative and/or informative surface which will be visible in the case an at least partially transparent basic structure is applied. In an alternative embodiment it is possible to envisage the holder enclosing a plurality of compartments, these compartments preferably being separated by means of at least one substantially vertically oriented partition. It is possible in this way to envisage storing several additives in the holder which remain mutually separated until the underside of the foil is opened.

The upper side of the holder can be embodied in different ways depending on the manner of opening of the upper side of the holder. It is for instance possible to envisage the upper side of the holder being formed by a preferably substantially rigid cover which is initially connected to the peripheral wall, optionally via a sealing element which preferably forms an oxygen barrier. The upper side of the holder can be opened by removing the cover, optionally in manual manner. It is however generally recommended to enable substantially medium-tight closure of the holder by means of the upper side so that the shelf life of the additive can be increased. It is therefore generally advantageous for the upper side to also be formed by a foil, particularly a perforable foil as specified in the foregoing. Just as the foil applied on the underside of the holder, the foil applied on the upper side can also be manufactured from one or more polymers, from a metal, or a combination thereof. Suitable polymers are polypropylene (PP) and/or ethylene vinyl alcohol (EVOH). EVOH has the specific property of functioning as oxygen barrier, this having a positive effect on the preservation of the additive held in the holder. The foil can also comprise aluminium which is optionally provided on one or two sides with a plastic layer, for instance a layer comprising PP or PE, in order to facilitate one-sided or two-sided adhesion of the foil to another part of the holder manufactured from (the same) plastic. It is also possible to envisage the foil comprising aluminium oxide (ALOX), optionally laminated with plastic such as polyethylene terephthalate (PET), whereby an exceptionally thin foil can be obtained with a thickness in the order of magnitude of several microns. The foil can be connected by means of gluing and/or welding to the peripheral wall of the holder. Perforation of the foil forming the upper side of the holder can take place manually. It is however recommended from a practical and hygienic viewpoint to also realize this perforation in mechanical manner, which can for instance be embodied by configuring the closing element such that the foil is perforated during uncoupling of the closing element from the basic structure. The closing element can here perforate the foil directly or via perforating means intended for the purpose. The latter option is generally recommended. The device therefore preferably comprises at least one upper perforation structure positioned above an upper side of the holder facing toward the closing element and configured to perforate the upper side of the holder during downward displacement of the upper perforation structure in the direction of the upper side of the holder. The upper perforation structure can be operated manually by pressing the perforation structure in the direction of the holder, whereby the (upper) foil is perforated. The upper perforation structure is however preferably displaced in the direction of the holder when the device is opened, i.e. during uncoupling of the closing element from the basic structure. This can for instance be realized by mutually coupling the basic structure and the closing element by means of a screw thread connection, wherein the basic structure is preferably provided with an external screw thread configured for co-action with an internal screw thread of the closing element. It is possible to obtain a rotating movement of the perforation structure by then providing the closing element with at least one displacing member configured to bring about axial co-rotation of the upper perforation structure during the axial rotation of the closing element. This rotating movement can be accompanied by a displacement of the perforation structure in axial direction toward the holder. It is advantageous for this purpose for the upper perforation structure to be provided with an external screw thread configured for co-action with an internal screw thread of the basic structure such that during axial rotation of the upper perforation structure relative to the basic structure the upper perforation structure can be displaced in downward direction for the purpose of perforating the upper side of the holder. The orientation of the screw thread connection between the closing element and the basic structure is therefore preferably opposite to the orientation of the screw thread connection between the basic structure and the upper perforation structure, whereby the desired movement in opposite directions can be realized. Instead of a screw thread connection it is also possible to envisage applying another type of connection, such as for instance a snap connection or bayonet closure, whereby a downward displacement of the holder and of the upper perforation structure can be realized.

It is advantageous for the upper perforation structure to be connected to an upper retaining structure, wherein the orientation between the perforation structure and the lower retaining structure can be changed. A construction similar to the lower retaining structure and the lower perforation structure is in this way obtained, and with similar advantages. The upper retaining structure is however preferably configured here to engage on a peripheral wall and/or the upper side of the holder such that during the downward displacement of the retaining structure the holder is also displaced in downward direction. It is advantageous here for the upper retaining structure and the upper perforation structure to be mutually connected by means of at least one pivot arm, wherein each pivot arm is pivotally connected with a first outer end to the upper retaining structure and is pivotally connected with an opposite second outer end to the upper perforation structure. By having the distance between the two outer ends of each pivot arm in a substantially unloaded state be greater than the distance between the upper retaining structure and the upper perforation structure when the upper retaining structure and the upper perforation structure, or at least the outer ends of the pivot arm, lie substantially in the same (horizontal) plane, the perforation structure can be urged into a preferred position lying at a distance from the upper retaining structure. In this upper construction it is also advantageous for the at least one pivot arm to take an angular or curved form. It is also advantageous here for the at least one pivot arm to take a resilient form. The same is the case for the application of a plurality of pivot arms in substantially uniform distribution relative to a peripheral side of the upper perforation structure, this generally enhancing a controlled and uniform displacement of the upper perforation structure.

It is usually advantageous for the upper perforation structure and/or the lower perforation structure to be provided with at least one passage opening for beverage, whereby beverage will encounter less resistance in leaving the device via the lower perforation structure, the holder and the upper perforation structure.

In a preferred embodiment the basic structure is configured for non-releasable connection to the beverage container. The basic structure is more preferably configured for substantially fixed connection to the beverage container. Such a non-releasable, preferably fixed connection between the basic structure and the beverage container prevents the basic structure being unintentionally uncoupled from the beverage holder during use, and moreover facilitates uncoupling of the closing element from the basic structure.

In a further preferred embodiment the closing element is connected to a tear-off sealing element which engages initially on the beverage container and/or the basic structure and tears off during uncoupling of the closing element from the basic structure. A tamper evident seal is in this way provided, on the basis of which a consumer can see at a glance whether the device has already been opened at an earlier stage.

The invention also relates to an assembly of a beverage container, in particular a bottle, and a device according to the invention coupled to the beverage container. A part of the device will generally be positioned here in the beverage container, in particular the bottle, whereby the total external volume of the assembly can be reduced. The beverage container will usually be filled with water, optionally already provided initially with one or more additives. The beverage container can initially be sealed with its own foil. In the case the beverage container itself is provided with such a foil, it is generally advantageous to apply under the lower perforation structure a further perforation structure which is configured to perforate the foil of the beverage container. Perforation of this foil of the beverage container by the further perforation structure will generally take place during perforation of the underside of the holder by means of the lower perforation structure. The invention further relates to a method for operating such an assembly, comprising the steps of: A) uncoupling the closing element relative to the basic structure, B) opening the upper side of the holder, and C) displacing the holder downward in the direction of the lower perforation structure such that the underside of the holder is perforated and additive can be released to beverage present in the beverage container. Advantages of such a method have already been described at length in the foregoing. Step A) will preferably set the whole process of two-sided opening (steps B) and C)) of the holder into operation, whereby following removal of the closing element from the basic structure the holder has been opened on two sides, the additive has been added to the beverage in the beverage container and the beverage is ready to be removed via the device of the assembly. Perforation of the upper side of the holder during step B) preferably takes place, as stated, by applying an upper perforation structure which is displaced during step B) in the direction of the upper side of the holder such that the upper side is perforated. During step C) a lower retaining structure is preferably displaced in downward direction, whereby a lower perforation structure connected displaceably to the lower retaining structure is urged in the direction of the holder such that the underside of the holder is perforated.

BRIEF DESCRIPTION OF THE DRAWINGS

The invention will be elucidated on the basis of non-limitative exemplary embodiments shown in the following figures. Herein.

DETAILED DESCRIPTION OF THE INVENTION

Figure 1A:
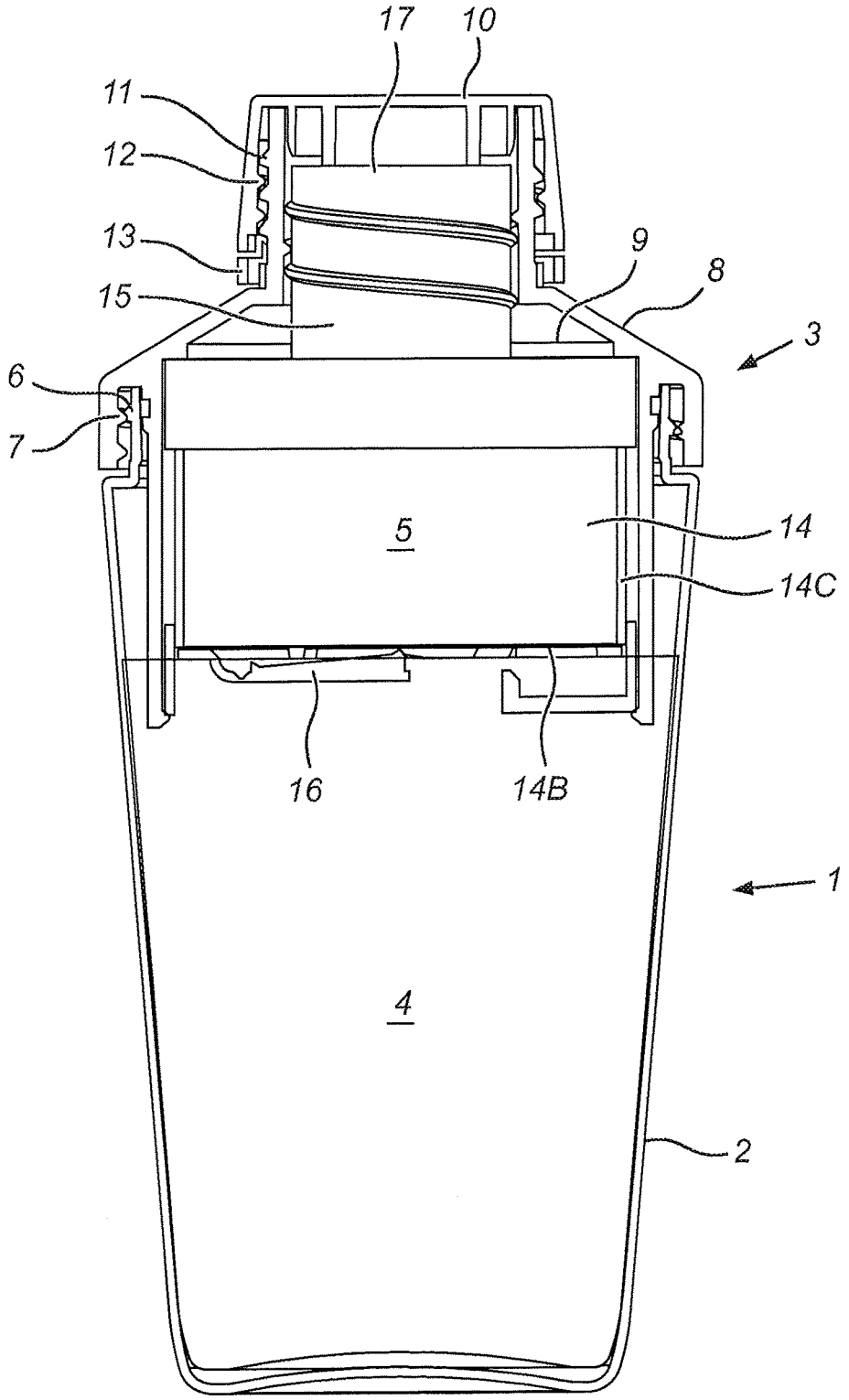
FIGS. 1 *a*-1*b* show different views of an assembly according to the invention.

FIG. 1*a* shows a cross-section of an assembly 1 according to the invention, this assembly 1 comprising a beverage container 2 and a device 3 coupled to beverage container 2 for closing beverage container 2 and for enriching beverage 4 held in beverage container 2, generally drinking water, with an additive in powder form 5 such as a water-soluble sugary additive, a vitamin preparation and/or a pharmaceutical preparation. Beverage container 2 is embodied in the form of a cup, wherein a part of device 3 is enclosed by beverage container 2. Beverage container 2 is provided with an external screw thread 6 which co-acts in the shown situation with an internal screw thread 7 of a basic structure 8 of device 3, thereby creating a screw thread connection between beverage container 2 and device 3. Basic structure 8 is provided with a passage channel 9 for beverage. The diameter of passage channel 9 varies in the longitudinal direction of passage channel 9, wherein an upper part of passage channel 9 is relatively narrow in order to enable controlled pouring of beverage from assembly 1, and wherein a lower part of passage channel 9 takes a relatively wide form in order that it can accommodate other components of device 3, as will be elucidated herein below.

Figure 1B:
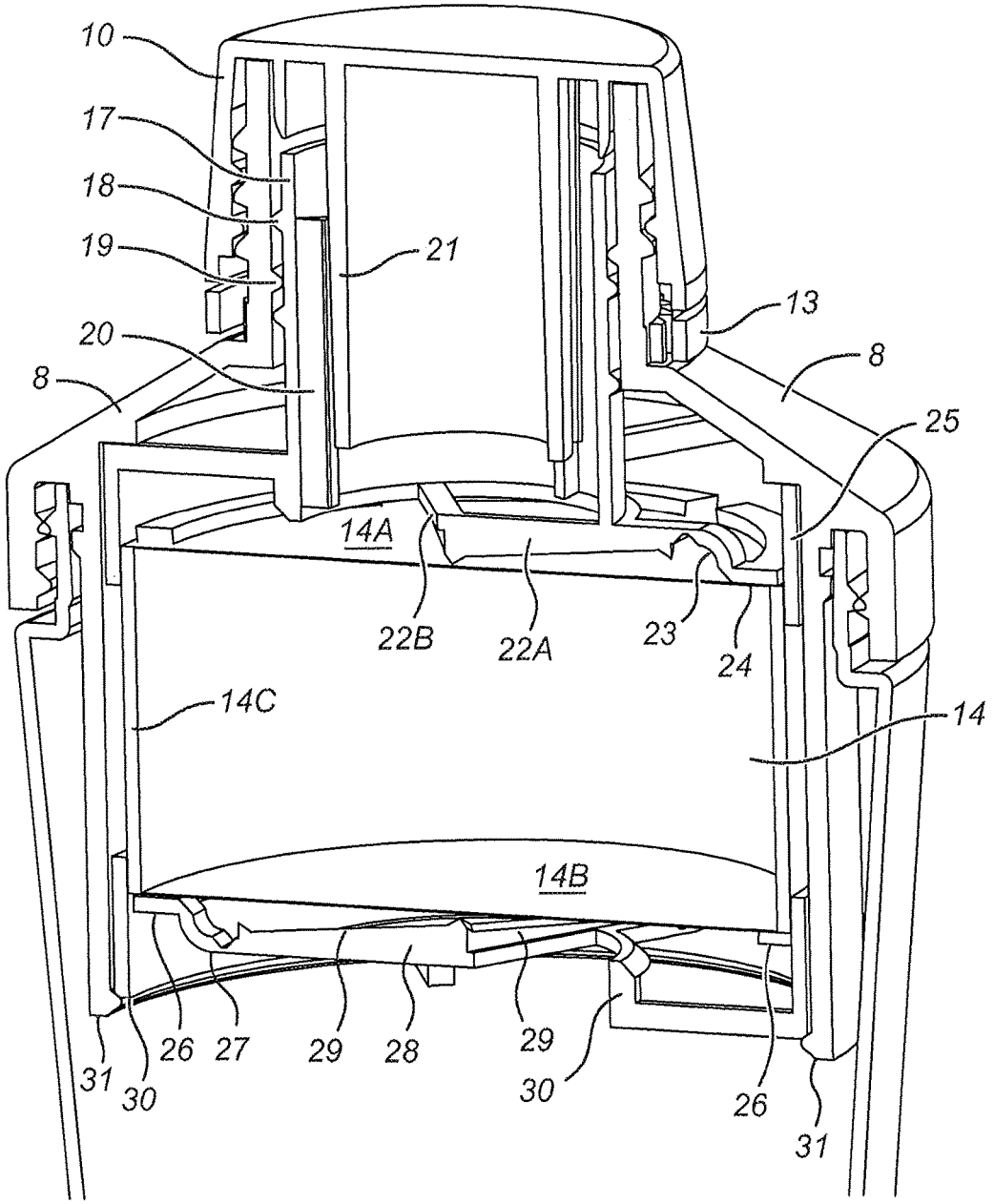

Device 3 comprises a closing element 10 coupled releasably to basic structure 8 for closing passage channel 9. Basic structure 8 is provided for this purpose with an external screw thread 11 configured for co-action with an internal screw thread 12 of closing element 10. Closing element 10 is further initially connected to a breakable sealing ring 13 on the basis of which a consumer—by way of quality control—can see at a glance whether closing element 10 has already been removed from basic structure 8 at an earlier stage. Passage channel 9 of basic structure 8 also forms a housing for a holder 14 for additive 5, this holder 14 taking a substantially cylindrical form in this exemplary embodiment. The two end surfaces of holder 14 are initially closed substantially medium-tightly by means of a foil 14*a*, 14*b* so that additive 5 can be stored for a relatively long time. Upper foil 14*a*, which forms the upper side of holder 14, can be perforated by an upper perforation structure 15, while lower foil 14*b*, which forms the underside of holder 14, can be perforated by a lower perforation structure 16, this being further elucidated herein below. Holder 14 is received form-fittingly and axially displaceably in passage channel 9 of basic structure 8. The upper perforation structure 1 is shown in further detail in FIG. 1*b*. The upper perforation structure 15 comprises an upright tubular element 17 provided on an outer side with an external screw thread 18 configured for co-action with an internal screw thread 19 of basic structure 8. An inner side of tubular element 17 is provided with one or more displacing protrusions 20 configured to be co-displaced by a part 21 of closing element 10 protruding into passage channel 9. Through axial rotation of closing element 10 relative to basic structure 8, particularly during uncoupling of closing element 10, the protruding part 21 of closing element 10 will cause tubular element 17 to rotate axially in the same direction, wherein as a result of said screw thread connection tubular element 17 is displaced in the direction of holder 14. The upper perforation structure 15 comprises three linear perforation elements 22*a*, 22*b* (only two of which are visible) which come together at a central perforation point and are connected substantially rigidly to tubular element 17. Downward displacement of tubular element 17 also results in downward displacement of perforation elements 22*a*, 22*b* such that, after sufficient displacement, the upper foil 14*a* will be provided with linear incisions, and will thus be perforated. Each of the perforation elements 22*a*, 22*b* is pivotally connected by means of a pivot arm 23 (only one of which is shown), wherein each pivot arm 23 is pivotally connected at an opposite outer end to an upper retaining structure 24. The upper retaining structure 24 can optionally take a segmented form. An outer peripheral side of retaining structure 24 engages in this exemplary embodiment on an annular skirt 25 of the upper perforation structure 15. An underside of retaining structure 24 engages on a substantially rigid peripheral wall 14*c* of holder 14. Downward displacement of the upper perforation structure 15 thus also results in downward displacement of retaining structure 24, and thereby of holder 14. However, due to the use of the pivotable curved pivot arms, also referred to as elbows, which initially hold the upper perforation structure 15 in an upper position relative to the surrounding retaining structure 24, the orientation of the upper perforation structure 15 will change relative to retaining structure 24 during the downward displacement. Because the upper perforation structure 15 encounters less resistance than retaining structure 24 during the downward displacement, the upper perforation structure 15 will tend to displace more easily and further than retaining structure 24, whereby pivot arms 23 will pivot and will urge the upper perforation structure 15 into a stable lower position relative to retaining structure 24, whereby foil 14*a* is perforated.

As a result of the downward displacement of holder 14 under the influence of the displacing upper retaining structure, peripheral wall 14*c* of holder 14 will also displace a lower retaining structure 26 in downward direction. The lower retaining structure 26 is pivotally connected to three curved pivot arms 27, wherein each pivot arm 27 is pivotally connected to lower perforation structure 28 provided with a plurality of perforation elements 29 configured to perforate lower foil 14*b*. Basic structure 8 is provided here with a bounding element 30 which supports on a flange 31 of basic structure 8 and functions to limit the downward displacement of the lower perforation structure 28. When the lower retaining structure 26 is displaced in downward direction the pivot arms 27 will deform as a result of the bounding of the downward displacement of the lower perforation structure 28, whereby the tension in pivot arms 27 and the tilting of pivot arms 27 will increase. Following sufficient tilting of pivot arms 27 the pivot arms 27 will press the lower perforation structure 28 in upward direction, wherein the tension on pivot arms 27 will be at least partially released and wherein the lower perforation structure 28 will perforate the lower foil 14*b*, whereby additive 5 can leave holder 14 as a result of gravitational force and mix with water 4. Uncoupling of closing element 10 from basic structure 8 will thus cause two-sided perforation of holder 14 from an outer side. When beverage 4 enriched with additive 5 is removed from assembly 1, it will be possible to remove beverage 4 from device 3 via holder 14.

Figure 2A:
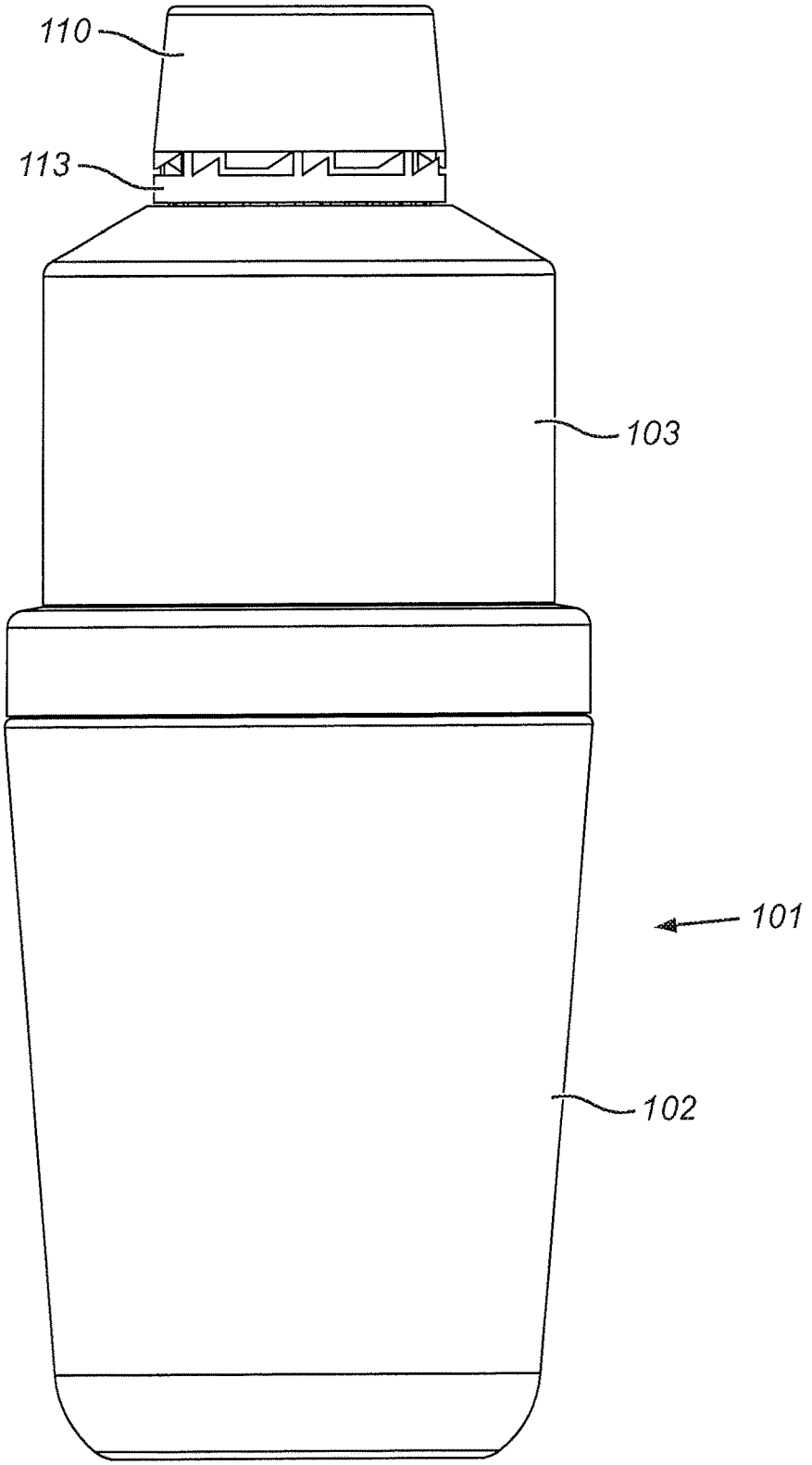
FIGS. 2*a*-2*b* show different views of another assembly according to the invention.
Figure 2B:
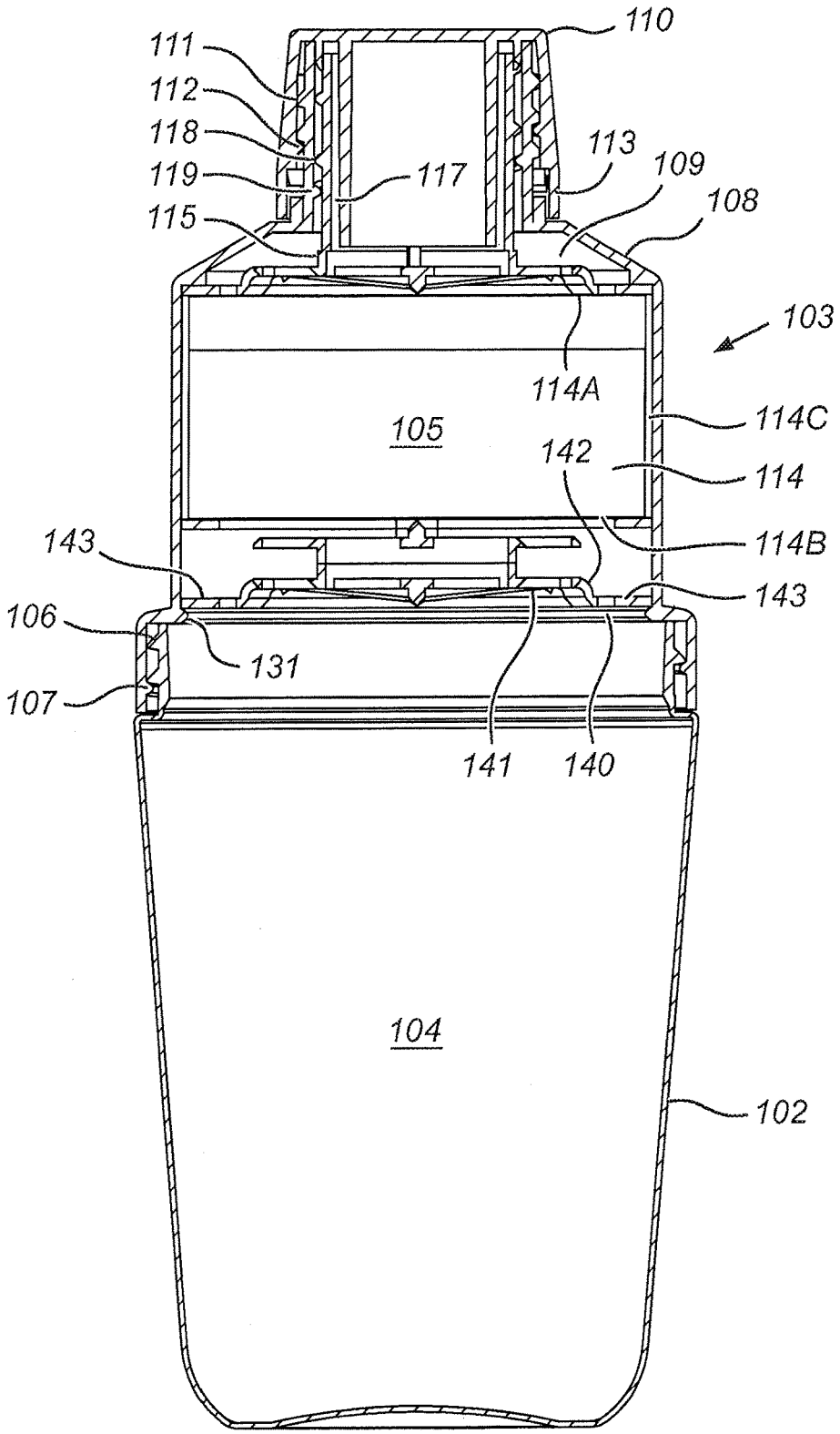
Figure 2C:
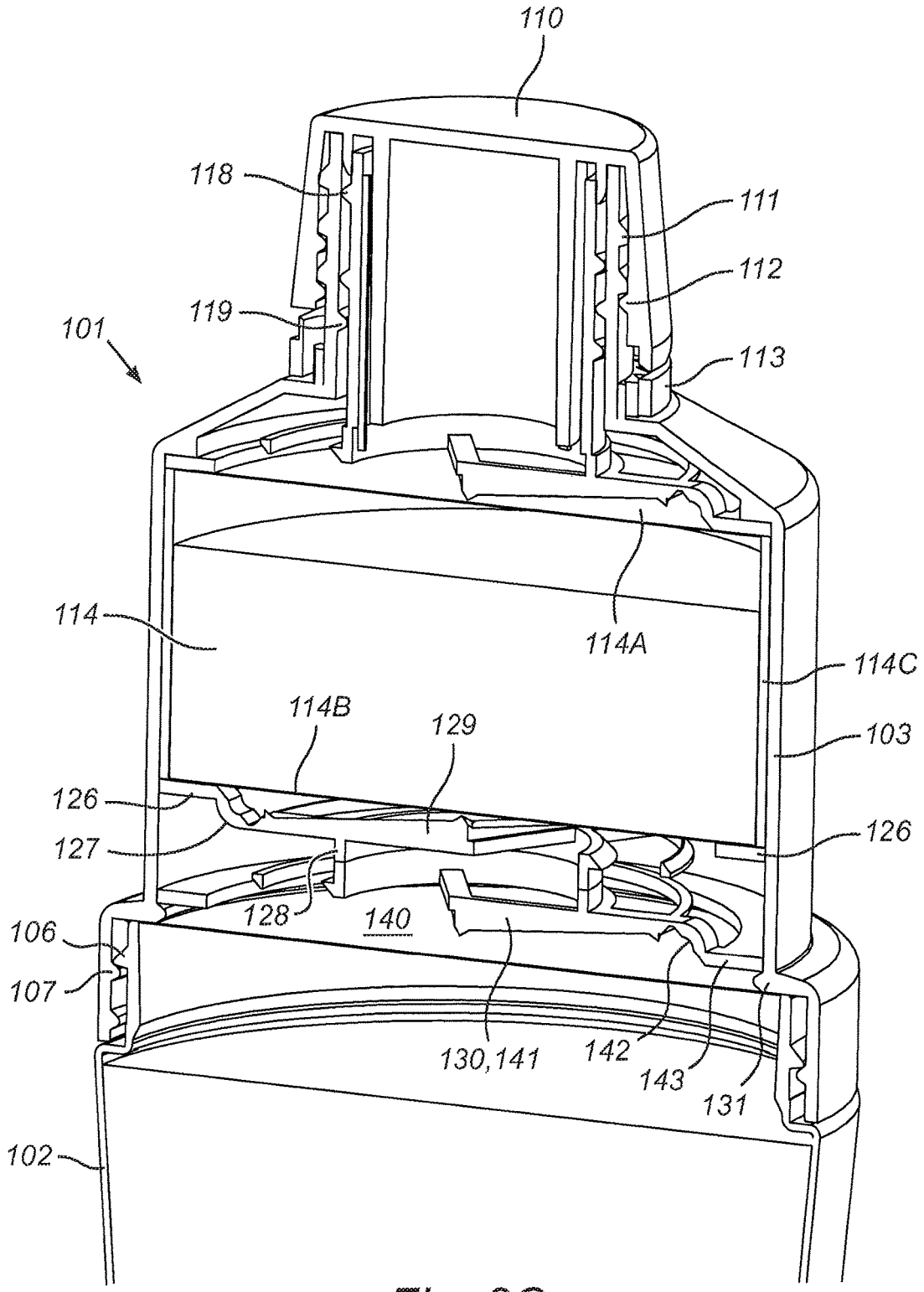
Figure 2D:
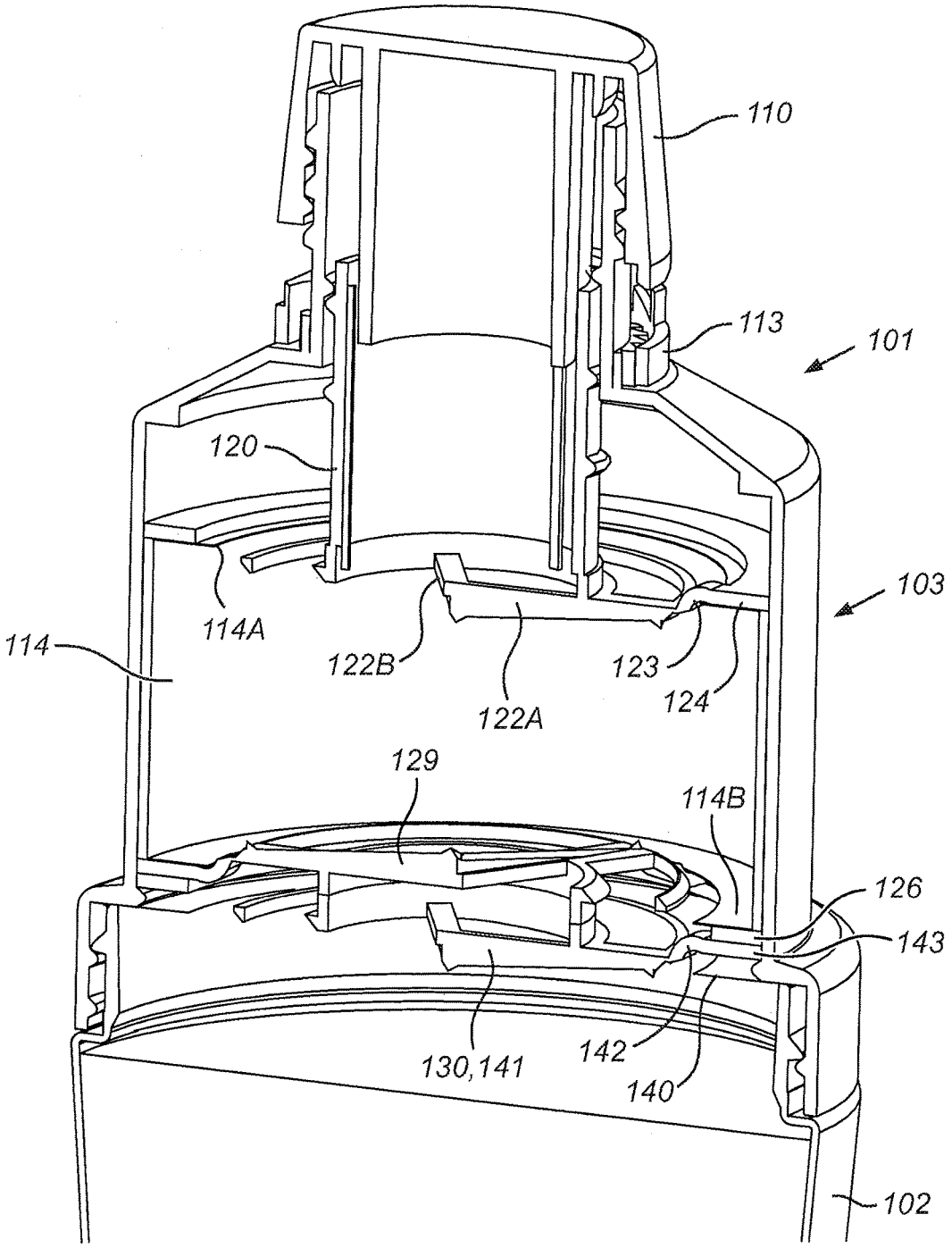

FIG. 2*a* shows a perspective view of another assembly 101 according to the invention, this assembly 101 comprising a beverage container 102 and a device 103 coupled to beverage container 102 for closing beverage container 102 and for enriching beverage 104, generally drinking water, held in beverage container 102 with an additive 105 in powder form. FIG. 2*b* shows a cross-section of assembly 101, wherein FIG. 2*c* shows a detailed perspective cross-section of assembly 101. FIGS. 2*a*-2*c* show the assembly in an initially sealed, closed state. FIG. 2*d* shows a detailed perspective cross-section of assembly 101 in opened state. Structurally the assembly 101 is highly similar to the assembly 1 shown in FIGS. 1*a* and 1*b*.

Beverage container 102 takes a cup-like form and is closed on an upper side by means of at least one foil 140. In this exemplary embodiment device 103 is positioned wholly outside beverage container 102. Beverage container 102 is provided with an external screw thread 106 which co-acts in the shown situation with an internal screw thread 107 of a basic structure 108 of device 103, thereby creating a screw thread connection between beverage container 102 and device 103. Basic structure 108 is provided with a passage channel 109 for beverage. Device 103 comprises a closing element 110 coupled releasably to basic structure 108 for closing passage channel 109. Basic structure 108 is provided for this purpose with an external screw thread 111 configured for co-action with an internal screw thread 112 of closing element 110. Closing element 110 is further initially connected to a breakable sealing ring 113 on the basis of which a consumer—by way of quality control—can see at a glance whether closing element 110 has already been removed from basic structure 108 at an earlier stage. Passage channel 109 of basic structure 108 also forms a housing for a holder 114 for additive 105, which holder 114 takes a substantially cylindrical form in this exemplary embodiment. The two end surfaces of holder 114 are initially closed substantially medium-tightly by means of a foil 114*a*, 114*b* so that additive 105 can be stored for a relatively long time. Upper foil 114*a*, which forms the upper side of holder 114, can be perforated by an upper perforation structure 115, while lower foil 114*b*, which forms the underside of holder 114, can be perforated by a lower perforation structure 116, this being further elucidated herein below. Holder 114 is received form-fittingly and axially displaceably in passage channel 109 of basic structure 108. Upper perforation structure 115 is shown in further detail in FIG. 2*c*. Upper perforation structure 115 comprises an upright tubular element 117 provided on an outer side with an external screw thread 118 configured for co-action with an internal screw thread 119 of basic structure 108. An inner side of tubular element 117 is provided with one or more displacing protrusions 120 configured to be co-displaced by a part 121 of closing element 110 protruding into passage channel 109. Through axial rotation of closing element 110 relative to basic structure 108, particularly during uncoupling of closing element 110, the protruding part 121 of closing element 110 will cause tubular element 117 to rotate axially in the same direction, wherein as a result of said screw thread connection tubular element 117 is displaced in the direction of holder 114. Upper perforation structure 115 comprises three linear perforation elements 122*a*, 122*b* (only two of which are visible) which are connected substantially rigidly to tubular element 117. Downward displacement of tubular element 117 also results in downward displacement of perforation elements 122*a*, 122*b* such that, after sufficient displacement, upper foil 114*a* will be provided with linear incisions, and will thus be perforated. Each of the perforation elements 122*a*, 122*b* is pivotally connected by means of a pivot arm 123 (only one of which is shown), wherein each pivot arm 123 is pivotally connected at an opposite outer end to an upper retaining structure 124. Upper retaining structure 124 can optionally take a segmented form. An outer peripheral side of retaining structure 124 engages in this exemplary embodiment on an annular skirt 125 of upper perforation structure 115. An underside of retaining structure 124 engages on a substantially rigid peripheral wall 114*c* of holder 114. Downward displacement of upper perforation structure 115 thus also results in downward displacement of retaining structure 124, and thereby of holder 114. However, due to the use of the pivotable curved pivot arms, also referred to as elbows, which initially hold upper perforation structure 115 in an upper position relative to the surrounding retaining structure 124, the orientation of upper perforation structure 115 will change relative to retaining structure 124 during the downward displacement, wherein the resilient pivot arms will deform to some extent. Because upper perforation structure 115 encounters less resistance than retaining structure 124 during the downward displacement, upper perforation structure 115 will tend to displace more easily and further than retaining structure 124, whereby pivot arms 123 will pivot and will urge upper perforation structure 115 into a stable lower position relative to retaining structure 124, whereby foil 114*a* is perforated.

As a result of the downward displacement of holder 114 under the influence of the displacing upper retaining structure, peripheral wall 114*c* of holder 114 will also displace a lower retaining structure 126 in downward direction. Lower retaining structure 126 is pivotally connected to three curved pivot arms 127, wherein each pivot arm 127 is pivotally connected to lower perforation structure 128 provided with a plurality of perforation elements 129 configured to perforate lower foil 114*b*. Basic structure 108 is provided here with a bounding element 130 which supports on a flange 131 of basic structure 108 and functions to limit the downward displacement of lower perforation structure 128. In this exemplary embodiment however, bounding element 130 is formed by an assembly of a further perforation structure 141 and a further retaining structure 143 connected for (dual) pivoting to further perforation structure 141 by means of pivot arms 142. The further retaining structure is in fact clamped between flange 131 of basic structure 108 and lower retaining structure 126. Further perforation structure 141 is configured to perforate foil 140 of beverage container 102. As lower perforation structure 128 initially displaces in downward direction displacement, further perforation structure 141 will also be displaced in downward direction. Further pivot arms 142 will preferably deform more easily than the lower pivot arms 127, whereby foil 140 of beverage container 102 will be perforated just before foil 114*b* of holder 114. This has the advantage that additive 105 can drop directly into the beverage and will not drop first onto foil 140 of beverage container 102, which would have the drawback that further perforation structure 141 would have to displace through the additive in powder form 105, this being undesirable as described in the description introduction of this patent specification. The further operation of the construction corresponds to the above described operation of the assembly 1 shown in FIGS. 1 *a* and 1*b*. Instead of curved resilient pivot arms, it is also possible to envisage applying substantially flat (non-curved) resilient pivot arms. It is possible to envisage applying a plurality of foils on the beverage container instead of one foil 140, wherein an (additional) additive can optionally be enclosed between different foils. The assembly of foils can then be perforated by means of the further perforation structure 141 during downward displacement thereof. It will be apparent that the invention is not limited to the exemplary embodiments shown and described here, but that within the scope of the appended claims numerous variants are possible which will be self-evident to the skilled person in this field.

The invention claimed is:

1. A device for closing beverage containers, comprising:

a basic structure configured for coupling to the beverage container, the basic structure enclosing at least one passage channel for a beverage, a closing element coupled releasably to the basic structure for closing the at least one passage channel, at least one axially displaceable holder which is arranged at least partially in the passage channel and which is at least partially filled with an additive to be added to the beverage, wherein an upper side of the holder to be opened facing toward the closing element and an underside of the holder remote from the closing element initially close the holder substantially medium-tightly, and at least one lower perforation structure positioned under an underside of the holder remote from the closing element and configured to perforate the underside of the holder during downward displacement of the holder in the passage channel in the direction of the lower perforation structure, whereby the additive can be released into the beverage present in the beverage container, wherein the lower perforation structure is connected to a lower retaining structure and wherein the orientation between the lower perforation structure and the lower retaining structure can be changed.

2. The device as claimed in claim 1, wherein a peripheral wall and/or the underside of the holder is configured to engage on the lower retaining structure such that, during the downward displacement of the holder, the lower retaining structure is also displaced in downward direction.

3. The device as claimed in claim 1, wherein the lower perforation structure is fixed to the basic structure.

4. The device as claimed in claim 3, wherein the lower perforation structure forms an integral part of the basic structure.

5. The device as claimed in claim 1, wherein the lower perforation structure is axially displaceable relative to the basic structure.

6. The device as claimed in claim 5, wherein the device comprises at least one bounding element for bounding the downward displacement of the lower perforation structure.

7. The device as claimed in claim 6, wherein the basic structure is configured to hold the bounding element.

8. The device as claimed in claim 6, wherein the basic structure and the bounding element are connected.

9. The device as claimed in claim 1, wherein the lower retaining structure and the lower perforation structure are mutually connected by at least one lower pivot arm, wherein each lower pivot arm is pivotally connected with a first outer end to the lower retaining structure and pivotally connected with an opposite second outer end to the lower perforation structure.

10. The device as claimed in claim 9, wherein the distance between the two outer ends of each lower pivot arm is greater in a substantially unloaded state than the distance between the lower retaining structure and the lower perforation structure when the lower retaining structure and the lower perforation structure lie substantially in the same plane.

11. The device as claimed in claim 9, wherein the at least one pivot arm is angled or curved.

12. The device as claimed in claim 9, wherein the at least one pivot arm is resilient.

13. The device as claimed in claim 9, wherein the device comprises a plurality of pivot arms uniformly distributed about a peripheral side of the lower perforation structure.

14. The device as claimed in claim 1, wherein the lower perforation structure is displaceable relative to the lower retaining structure between a lower position, in which the lower perforation structure leaves the underside of the holder intact, and an upper position in which the lower perforation structure perforates the underside of the holder.

15. The device as claimed in claim 14, wherein the at least one pivot arm is configured to urge the lower perforation structure into a predetermined position.

16. The device as claimed in claim 1, wherein the displaceable lower retaining structure is enclosed by the passage channel.

17. The device as claimed in claim 1, wherein at least a part of the lower perforation structure is received for axial displacement in the passage channel.

18. The device as claimed in claim 1, wherein a channel wall forming part of the basic structure and defining the passage channel connects form-fittingly to a peripheral wall of the holder.

19. The device as claimed in claim 1, wherein the underside of the holder is formed by a perforable foil.

20. The device as claimed in claim 1, wherein the upper side of the holder is formed by a perforable foil.

21. The device as claimed in claim 20, wherein the closing element is configured to perforate the foil during uncoupling of the closing element from the basic structure.

22. The device as claimed in claim 20, wherein the device comprises at least one upper perforation structure positioned above an upper side of the holder facing toward the closing element and configured to perforate the upper side of the holder during downward displacement of the upper perforation structure in the direction of the upper side of the holder.

23. The device as claimed in claim 22, wherein the upper perforation structure is connected to an upper retaining structure, wherein the orientation between the perforation structure and the lower retaining structure can be changed.

24. The device as claimed in claim 23, wherein the upper retaining structure is configured to engage on a peripheral wall and/or the upper side of the holder such that during the downward displacement of the retaining structure the holder is also displaced in downward direction.

25. The device as claimed in claim 23, wherein the upper perforation structure is configured for downward displacement in the direction of the holder.

26. The device as claimed in claim 25, wherein the upper perforation structure is configured for co-action with the closing element such that during uncoupling of the closing element from the basic structure the upper perforation structure is displaced in a downward direction for the purpose of perforating the upper side of the holder.

27. The device as claimed in claim 1, wherein the closing element is axially rotatable relative to the basic structure.

28. The device as claimed in claim 27, wherein the basic structure is provided with an external screw thread configured for threaded engagement with an internal screw thread of the closing element.

29. The device as claimed in claim 25, wherein the upper perforation structure is provided with an external screw thread configured for threaded engagement with an internal screw thread of the basic structure such that during axial rotation of the upper perforation structure relative to the basic structure the upper perforation structure is displaced in downward direction for perforating the upper side of the holder.

30. The device as claimed in claim 23, wherein the upper retaining structure and the upper perforation structure are mutually connected by at least one upper pivot arm, wherein each upper pivot arm is pivotally connected with a first outer end to the upper retaining structure and is pivotally connected with an opposite second outer end to the upper perforation structure.

31. The device as claimed in claim 30, wherein the distance between the two outer ends of each upper pivot arm in a substantially unloaded state is greater than the distance between the upper retaining structure and the upper perforation structure when the upper retaining structure and the upper perforation structure lie substantially in the same plane.

32. The device as claimed in claim 30, wherein the at least one pivot arm is angled or curved.

33. The device as claimed in claim 30, wherein the at least one pivot arm is resilient.

34. The device as claimed in claim 30, wherein the device comprises a plurality of pivot arms uniformly distributed about a peripheral side of the upper perforation structure.

35. The device as claimed in claim 23, wherein the upper perforation structure is displaceable relative to the upper retaining structure between an upper position, in which the upper perforation structure leaves the upper side of the holder intact, and a lower position in which the upper perforation structure perforates the upper side of the holder.

36. The device as claimed in claim 35, wherein the at least one pivot arm is configured to urge the upper perforation structure into a predetermined position.

37. The device as claimed in claim 23, wherein the upper perforation structure is provided with at least one passage opening for the beverage.

38. The device as claimed in claim 1, wherein the lower perforation structure is provided with at least one passage opening for passage of the additive to be added to the beverage and for passage of the beverage.

39. The device as claimed in claim 1, wherein the additive is in powder form.

40. The device as claimed in claim 1, wherein the holder is tubular.

41. The device as claimed in claim 1, wherein the basic structure is permanently attached to the beverage container.

42. The device as claimed in claim 1, wherein the basic structure is fixed to the beverage container.

43. The device as claimed in claim 1, wherein the closing element is connected to a tear-off sealing element which engages initially on the beverage container and/or the basic structure and tears off during first uncoupling of the closing element from the basic structure.

44. The device as claimed in claim 1, wherein at least a part of the upper side of the holder is formed by a cover which is removable from another part of the holder.

45. The assembly of a beverage container and a device as claimed in claim 1 coupled to the beverage container.

46. A method for operating an assembly comprising a basic structure configured to couple to a beverage container and enclosing at least one passage channel for a beverage, a closing element releasably coupled to the basic structure for closing the at least one passage channel, at least one axially displaceable holder arranged at least partially in the passage channel and at least partially filled with an additive to be added to the beverage, wherein an upper side of the holder to be opened facing toward the closing element and an underside of the holder remote from the closing element initially close the holder, and at least one lower perforation structure positioned under an underside of the holder remote from the closing element and configured to perforate the underside of the holder during downward displacement of the holder in the passage channel in the direction of the lower perforation structure, whereby the additive can be released into the beverage in the beverage container, the method comprising the steps of:

A) uncoupling the closing element relative to the basic structure,

B) opening the upper side of the holder, and

C) displacing the holder downward in the direction of the lower perforation structure such that the underside of the holder is perforated and the additive can be released into the beverage in the beverage container.

47. The method as claimed in claim 46, wherein step B) is performed by performing step A).

48. The method as claimed in claim 46, wherein step C) is performed by performing step A).

49. The method as claimed in claim 46, wherein an upper perforation structure is displaced during step B) in the direction of the upper side of the holder such that the upper side is perforated.

50. The method as claimed in claim 46, wherein during step C) a lower retaining structure is displaced in a downward direction, whereby a lower perforation structure connected displaceably to the lower retaining structure is urged in the direction of the holder such that the underside of the holder is perforated.

* * * * *